US007240391B1

(12) United States Patent
Boze et al.

(10) Patent No.: US 7,240,391 B1
(45) Date of Patent: Jul. 10, 2007

(54) MANUAL WIPING SYSTEM AND METHOD

(76) Inventors: James C. Boze, 27336 County Rd. 4, Elkhart, IN (US) 46514; Manfred K. Lenz, 140 E. Prospect Ave., Mt. Vernon, NY (US) 10550

( * ) Notice: Subject to any disclaimer, the term of this patent is extended or adjusted under 35 U.S.C. 154(b) by 0 days.

(21) Appl. No.: 11/198,739

(22) Filed: Aug. 5, 2005

Related U.S. Application Data

(60) Provisional application No. 60/600,519, filed on Aug. 11, 2004.

(51) Int. Cl.
*A47L 13/18* (2006.01)

(52) U.S. Cl. ..... 15/227; 15/104.94; 2/158

(58) Field of Classification Search ..... 15/104.94, 15/227; 2/158, 159, 161.6; D28/63; D32/35, D32/40
See application file for complete search history.

(56) References Cited

U.S. PATENT DOCUMENTS

| | | | | |
|---|---|---|---|---|
| 1,547,179 | A * | 7/1925 | Martens | 401/201 |
| 1,941,320 | A * | 12/1933 | Pamplin | 401/7 |
| 2,103,455 | A * | 12/1937 | Greenwald | 15/227 |
| 2,374,068 | A * | 4/1945 | Baldeschwieler | 15/227 |
| 2,988,049 | A * | 6/1961 | Bean | 119/633 |
| 4,270,228 | A * | 6/1981 | Gaiser | 2/158 |
| D291,258 | S | 8/1987 | Greer, Sr. | |
| 4,964,188 | A | 10/1990 | Olson | |
| 5,008,969 | A | 4/1991 | Jarrett | |
| D356,195 | S | 3/1995 | Krueger et al. | |
| 5,924,160 | A | 7/1999 | Bradley | |
| D418,954 | S * | 1/2000 | Ferdenzi | D32/35 |
| 6,281,259 | B1 | 8/2001 | Hausdorf et al. | |
| 6,292,949 | B1 * | 9/2001 | Chang | 2/159 |
| 6,298,515 | B1 | 10/2001 | Robinson | |
| 6,603,054 | B2 | 8/2003 | Chen et al. | |
| 6,620,503 | B2 | 9/2003 | Qin et al. | |
| 6,712,121 | B2 | 3/2004 | Clark et al. | |
| 2002/0000017 | A1 * | 1/2002 | Brown et al. | 15/227 |
| 2004/0163196 | A1 * | 8/2004 | McKenzie | 15/227 |

FOREIGN PATENT DOCUMENTS

| | | | |
|---|---|---|---|
| EP | 068516 | * | 1/1982 |
| EP | 820705 | * | 1/1998 |

* cited by examiner

*Primary Examiner*—Mark Spisich
(74) *Attorney, Agent, or Firm*—Milde & Hoffberg LLP

(57) ABSTRACT

A wipe, comprising a hollow shell formed of a flexible sheet, having a first end and a second end having a cuff; and at least one side port, the side port being formed in a wall of the shell at a distance from the sealed first end, the hollow shell being adapted for at least one of cleaning, wiping, polishing, applying a liquid to a surface, and treating a surface, the cuff being adapted to retain the hollow shell about the wrist of a human wearer, and the at least one side port being adapted for insertion of a human thumb therethrough when the hollow absorbent fabric shell is placed over a human hand. The hollow shell is preferably an absorbent fabric.

17 Claims, 4 Drawing Sheets

MANUAL WIPING SYSTEM AND METHOD

CROSS REFERENCE TO RELATED APPLICATION

The present application claims benefit of priority from U.S. Provisional Patent Application 60/600,519, filed Aug. 11, 2004.

FIELD OF THE INVENTION

The present invention relates to the field of manual wiping and cleaning materials, and more particularly to a manual wipe which provides protection for the hand while retaining manual dexterity in use.

BACKGROUND OF THE INVENTION

A number of wipes have been used over the ages, including cloth towels and rags, paper, non-wovens sheets, and the like. These have been formed as sheets or gloves.

For example, see U.S. Pat. Nos. 5,924,160, 5,008,969, 4,964,188, 6,298,515, 6,281,259, D.356,195, and D.291, 258, each of which is expressly incorporated herein by reference.

The known Swiffer® is a disposable pre-impregnated non-woven pad designed for floor cleaning.

SUMMARY OF THE INVENTION

The present invention provides a multi-purpose cleaning, wiping and polishing device to be worn on the user's hand, which is typically used in conjunction with a leak proof glove, to shield the user's hand from cleaning or wiping liquids. The wipe itself may be wet with various agents, for example, cleaners, polishes, creams, ointments, oils, and the like. The wipe may be disposable or reusable. In one embodiment, the wipe is pre-impregnated with a wiping liquid, and is disposable after use.

The wipe itself may be formed of different materials depending on the application, which for example can vary in absorbency, chemical or solvent resistance, abrasiveness, strength, antimicrobial treatments, or other characteristics. Likewise, the liner glove may also be adapted for its purpose, for example made of plastic, rubber, or other materials.

In operation, the user places his or her hand inside of the glove liner, and then inserts the gloved hand into a hollow wipe, with the thumb optionally projecting through a side aperture in the wipe. A cuff is provided around the wearer's wrist to retain the wipe in position. The liner glove and wipe may also be integral.

The combination of liner glove and wipe provides enhanced protection to the user's hand, and because the pads and/or liner gloves are potentially reusable there would be a lot less waste of natural resources than with other cleaning methods, while providing a potentially low cost, high functionality device.

In one embodiment, the liner glove comprises a leak proof polyethylene mitt, for example 1.75 mil, over which a cleaning, wiping, or polishing wipe is placed. The wipe can be used, for example, to clean and maintain walls, floors, and countertops.

One type of wipe is an all-purpose food service cloth, used primarily in the food service industry for washing dishes and cleaning counter tops. This wipe can also be used for cleaning in other areas of the home, such as the bathroom and for cleaning tiled floors or painted walls. This is fabricated from, for example, Kimberly Clark WypAll Foodservice Towels.

A second type of wipe is designed to be used for cleaning things such as ovens, bathtubs, toilets, and washing automobiles or cleaning a workspace. This is fabricated from, for example, Kimberly Clark WypAll X80 wipers.

A third type works very well in heavy duty cleaning and wiping. This may also be used in heavily soiled surfaces and tools. It has good absorption of liquids, and absorbs fast to clean up grease, grime, solvents and chemicals. It is soft and pliable so it wont't scratch delicate surfaces, and is safe for wiping the hands or face. This is fabricated from, for example, Kimberly Clark WypAll X70 wipers.

A fourth type works well in the application of lubricants and polishes. Dusting furniture is one usage. It can be used for cleaning of automobiles and other equipment. This wipe has low lint wipe, and can be used in the cleaning of windows and polishing of silver and other objects such as shoes, jewelry and automobiles etc. This is fabricated from, for example, Kimberly Clark WypAll X50 wipers.

A fifth type is useful for absorption of liquid spills and leaks, routine industrial cleaning and maintenance, and may also be used for removing soil from face and hands. This is fabricated from, for example, Kimberly Clark WypAll L40 Wipers.

The wipe according to the present invention may be adapted for a variety of chores, for example, automobile detailing, stainless steel polishing, kitchen cleaning, window cleaning, cleaning countertops, bathroom fixtures, and toilet bowels and other bathroom porcelain.

The wipes can be provided in moistened form, with various liquids, such as soaps, detergents, glass cleaners, oven cleaners, caustics, silicones and siloxanes, oils, abrasives, insecticides, polishes, dyes, stains, pigments, sunscreen, medications, bleach or other oxidizers, reducing agents, silver polish, paint, curable polymers, floor cleaner, and wax, for example.

A preferred embodiment of the present invention therefore provides a wipe, comprising a hollow absorbent fabric shell, having a sealed first end and a second end having a cuff; and at least one side port, said side port being formed in a wall of said shell at a distance from said sealed first end, said hollow absorbent fabric shell being adapted for at least one of cleaning, wiping, polishing, applying a liquid to a surface, and treating a surface, said cuff being adapted to retain said hollow absorbent fabric shell about the wrist of a human wearer, and said at least one side port being adapted for insertion of a human thumb therethrough when said hollow absorbent fabric shell is placed over a human hand. In a preferred embodiment, the shell has a length of between about 5-15 inches, more preferably between about 10.5-12.5 inches, and a circumference of about 10-14 inches, the cuff has a resting circumference of about 35-80% of the circumference of the shell, and an elastic deformation limit of at least 125% of its resting circumference, and the side port is formed in a wall of said shell having a center at a distance of about 60-200% of the circumference from said sealed first end, and more preferably about 100% of the circumference distance. These dimensions correspond to a range of human hand dimensions. The wipe is preferably manufactured in three sizes, small, medium and large, intended to comfortably fit over 85% of the adult population, although a larger number of sizes may be provided for children and those with very large hands.

Preferably, apertures are formed on opposed sides of the wipe to permit use of the front and back of the wipe, with the thumb respectively protruding from one or the other aperture.

The absorbent fabric shell may be a woven or non-woven fabric, which is a cellulosic, synthetic, composite, or other sheet or tube material. The absorbent fabric may be treated with an antimicrobial agent, See U.S. Pat. No. 6,712,121, and references cited therein, expressly incorporated herein by reference. The absorbent fabric comprises, for example, hydro-entangled wood pulp and textile fibers, and/or a crosslinked copolymer of at least two types of monomers each comprising a respective functional group, wherein a functional group of a first type of monomer selectively cross links with a functional group of a second type of monomer, e.g., wherein the monomers are water soluble blend of ethylenically unsaturated monomers, and the functional groups comprise carboxylic acid groups and an amino groups and wherein said cross links comprise amide linkages (see, U.S. Pat. No. 6,620,503, expressly incorporated herein by reference), and/or crosslinked cellulosic fibers, and/or an insoluble hydrophilic foamable binder material (see, U.S. Pat. No. 6,603,054, expressly incorporated herein by reference).

In a preferred embodiment, the wipe is formed of a microfiber, such as the miracle cloth ® from Starfiber®. Microfiber is a cloth made of fiber of less than 1.0 denier, and for example, 0.2-0.15 denier (Aquastar, Inc.). The microfiber may be inhomogeneous, for example having a component made of polyamide (e.g., nylon), and a component made of polyester. The microfiber may be shaped to provide enhanced cleaning and cohesion, and has been described as containing "hooks" which retain particulates. Likewise, it may contain hydrophilic and/or lipophilic domains, to absorb both aqueous and oily substances. Generally, microfiber cloths are untreated, although according to the present invention, additional components such as cleansers, waxes, polishes, abrasives, oils, emollients, creams, silicones, and the like may be provided in the microfiber cloth.

The absorbent fabric 1 may be provided as a seamless tube, which is then closed at one end 6 and formed as a cuff on the other, with at least one aperture 4 formed in a sidewall thereof for the thumb. Alternately, the absorbent fabric shell may be formed by joining opposed edges of at least one planar sheet to form a seamed tube. These edges may be sewn, glued, melted together, as shown in FIG. 9. Likewise, the cuff may be formed using an additional formed elastic element, such as a band or ribbon including a natural or synthetic rubber, or created using an elastic liquid or gel. The cuff can be a hollow torroidal space, with an elastic or drawstring placed therein. The cuff and/or other seams may be formed using an adhesive, heat melting, ultrasonic, or sewing (or other mechanical) process, for example. The cuff may also provide an adjustable unstretched circumference band, that is, the unstretched length of the band is adjusted, for example by a button or snap, hook-and-loop fastener, adhesive, hooks, or the like. A drawstring is, for example, an elastic element provided within a hollow circumferential (torroidal) space bounded by said absorbent fabric shell, wherein the element can be tensioned to limit the effective circumference of the opening to less than the untensioned circumference. The element may be elastic or non-compliant.

The wipe preferably consists essentially of biodegradable materials, allowing environmentally sensitive disposal.

The wipe may further include a liquid-impermeable barrier glove, which may be integral or separable from the wipe.

The side port for the thumb is preferably reinforced, for example comprising a reinforced edge comprising at least two thicknesses of fabric. The doubled fabric may be overfolded, for example.

The invention also provides a method of wiping, comprising: placing a liquid impermeable glove on the hand of a human wearer; placing a hollow absorbent fabric shell, having a sealed first end and a second end having a cuff over the glove, with the thumb protruding through a side of the shell; and wiping a surface with the shell.

In another embodiment of the invention, a formed thumb is provided, thus making a mitten. A pair of thumb extensions may be provided, permitting use of both sides of the wipe.

DETAILED DESCRIPTION OF THE PREFERRED EMBODIMENT

Example 1

Figures 1, 2, 3, 4:
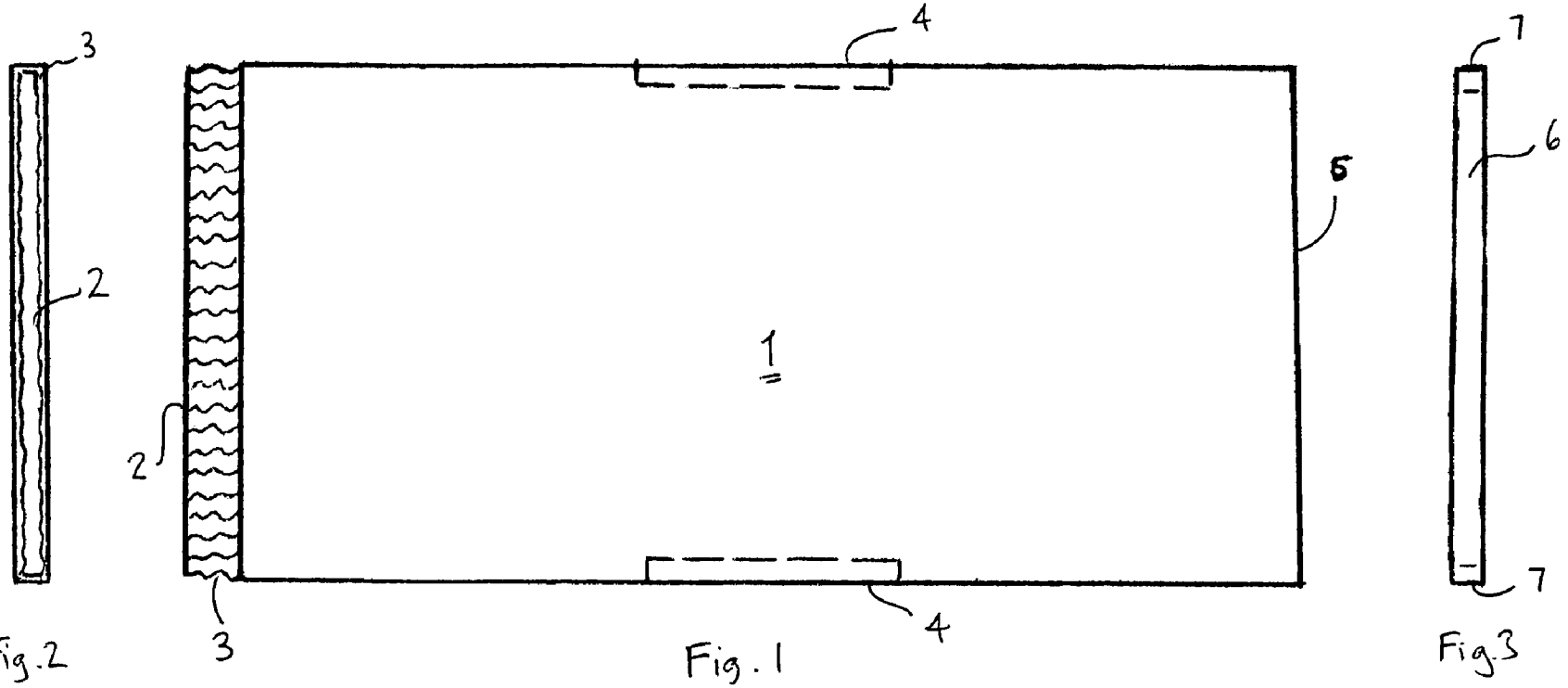
FIG. 1 shows a top view of the wipe according to a first embodiment of the present invention.
FIG. 2 shows a cuff side view of the wipe of FIG. 1.
FIG. 3 shows an end view of the wipe of FIG. 1.
FIG. 4 shows a side profile view of the wipe of FIG. 1.
Figure 5:
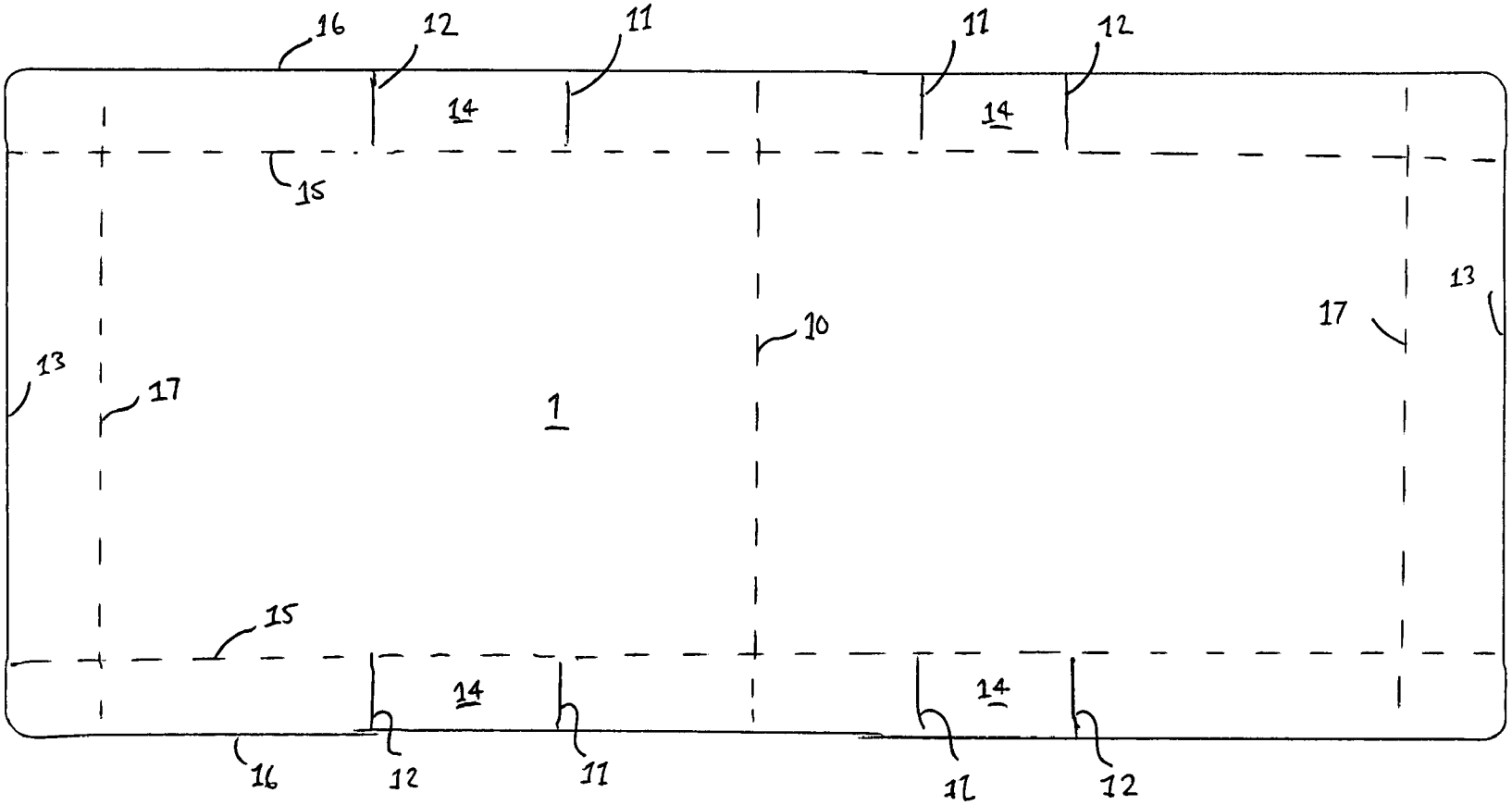
FIG. 5 shows a blank sheet used for fabrication of the wipe according to FIG. 1.

FIGS. 1-5 show a first embodiment of the invention.

A non-woven sheet material 1, such as Kimberly Clark WypAll Foodservice Towel material, which is available in 24 inch wide rolls, is cut into 7 inch lengths. The sheet is folded over once in the middle 10, to form two sides 7 each 7 inches by 12 inches. A pair of notches for the thumb ports 4 are defined by slits 11, 12 formed ½ inch into the material 1 at approximately 6 inches and 8 inches from the free ends 13. The flap 14 for each thumb port is then doubled over and sewn. The side seams 15 are then sewn approximately ½ inch from the side edge 16, leaving the thumb ports 4 open. An elastic band, for example a ½ inch wide clothing elastic, with a maximum stretch of about 200% of resting length, is then placed into a space formed by doubling over the free end 13 of the material, which is then tacked in place and drawn to a static (unstretched) circumference of about 6 inches. The space with the elastic is then sewn closed at a seam 17 approximately ¾ inch from the free end 13, forming a hollow torroidal space with the elastic inside, as the cuff 3.

The wipe therefore has a closed end 6, an elastic cuff 3 and an opposite end 2, two thumb ports 4, and seams at either side 7.

A standard liquid impervious glove or mitten, for example a rubber utility glove or 1.75 mil polyethylene mitt (not shown) is worn by a user under the wipe, with the thumb extending through the side port. The wipe may then be use for cleaning, polishing, wiping, etc. The wipe may be cleaned and reused, or simply disposed of. The liner glove may be replaced separately from the wipe, although according to another embodiment the wipe and liner are integral.

The wipe may be pre-impregnated with various types of solutions, such as lotions, medications, cleaners or chemicals, permitting the skin of the wearer to be insulated from the chemical or liquid while maintaining manual dexterity. In this case, the liner glove is packaged separately to avoid becoming wet. Alternately, the liner may be provided as a sealed space, which is opened only upon use, and therefore dry.

For kitchen, bathroom, and sanitary use, the wipe material 1 may be treated with an antimicrobial, e.g., 3-(trimethoxysilyl)propyloctadecyldimethyl ammonium chloride.

Example 2

Figure 6:
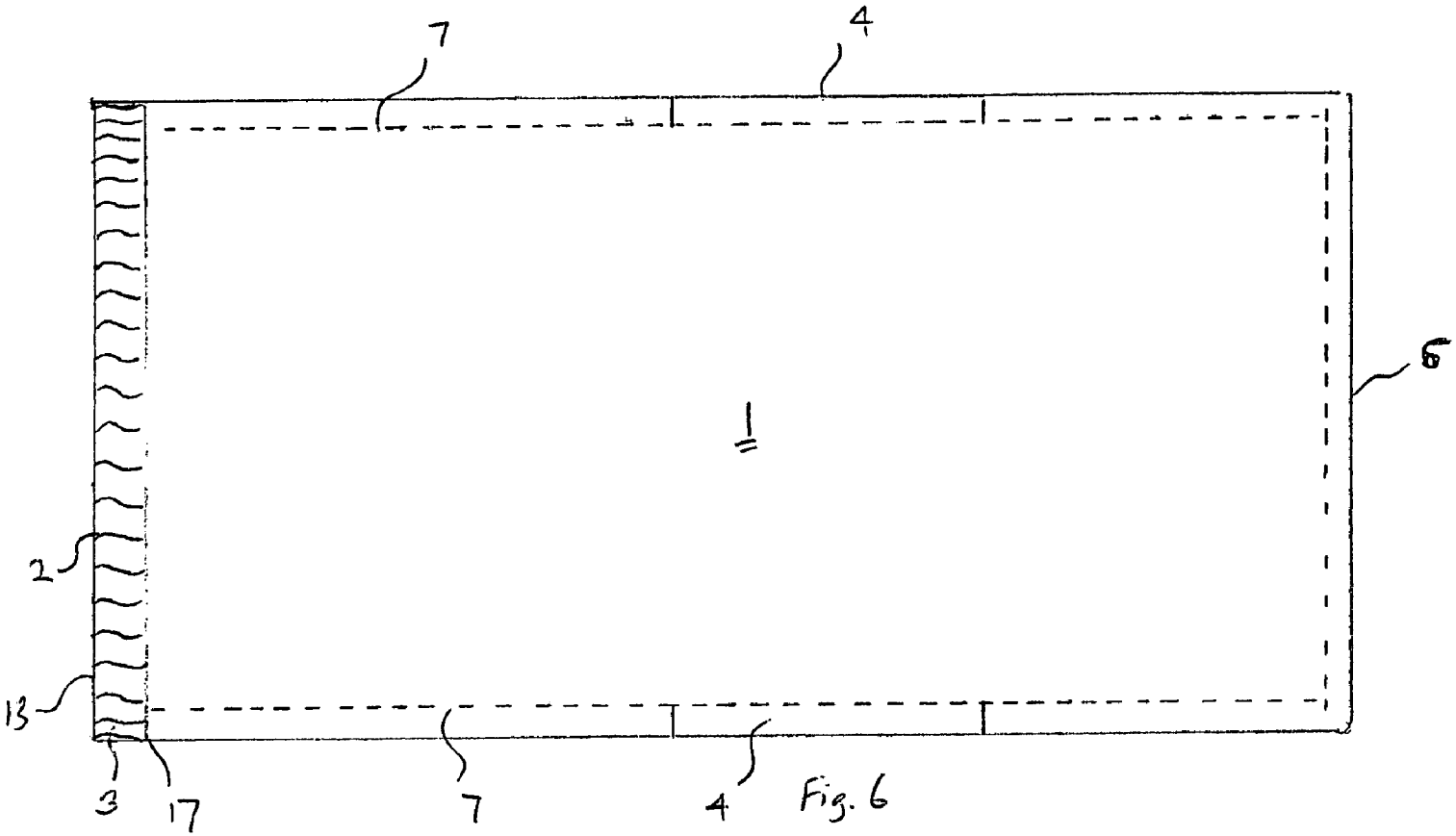
FIG. 6 shows a top view of the wipe according to a second embodiment of the present invention.
Figure 8:
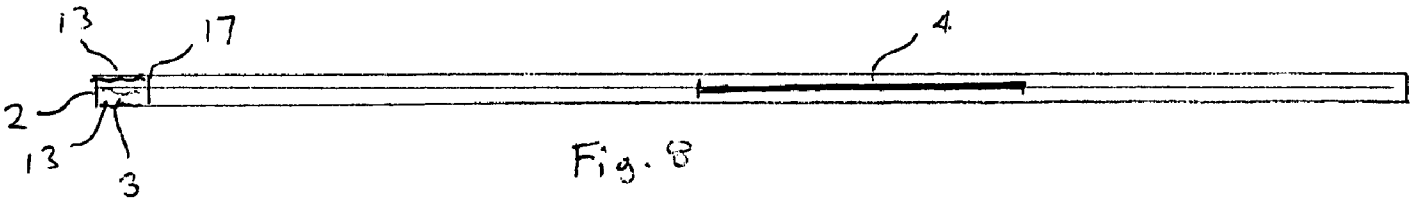
FIG. 8 shows an end view of the wipe of FIG. 6.
Figure 7:
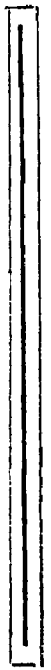
FIG. 7 shows a cuff side view of the wipe of FIG. 6.
Figure 9:
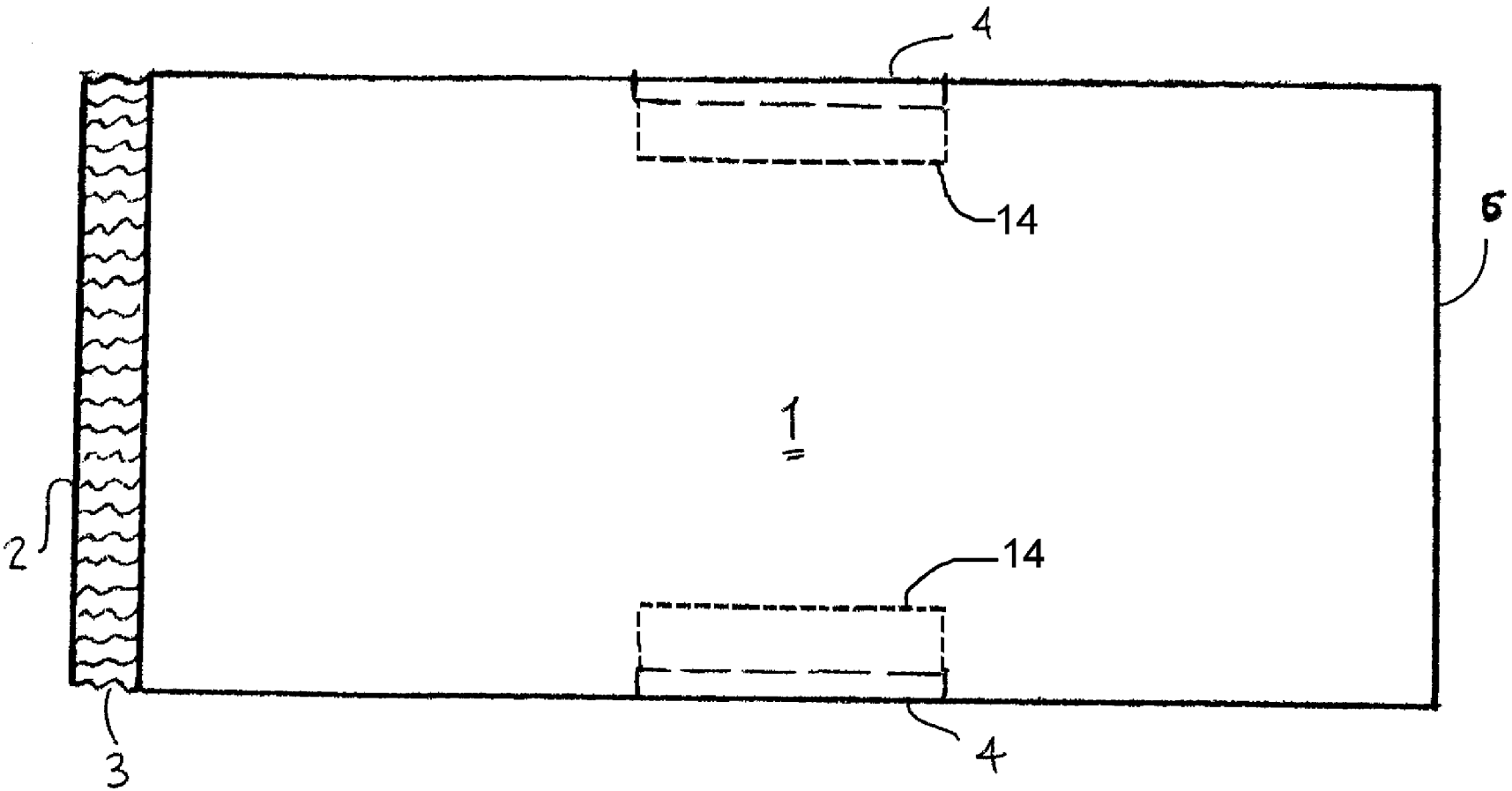
FIG. 9 shows a top view of a third embodiment of the present invention.

FIGS. 6-8 show a second embodiment of the invention.

A non-woven sheet material 1, such as Starfiber® microfiber sheet, is cut into 7 inch by 24 inch sheets. The sides, along the 24 inch edges, are folded over by about 0.25-1.0 inch (depending on the desired final size), and sewn. The sheet is then folded over once in the middle, to form two sides 7 each 6.5-5 inches by 12 inches. The overlapping side edges 7 are then sewn together in a seam about ⅛ inch from the free edge, except at the thumb ports 4, where they are left unattached. The thumb ports 4 are provided at between approximately 4 inches and 7 inches from the free ends 13. The end of the seam may be reinforced with an extra stitch.

An elastic band, for example a ½ inch wide clothing elastic, with a maximum stretch of about 200% of resting length, is then placed into a space formed by doubling over the free end 13 of the material, which is then tacked in place and drawn to a static (unstretched) circumference of about 6-7 inches. The space with the elastic is then sewn closed at a seam 17 approximately ¾ inch from the free end 13, forming a hollow torroidal space with the elastic inside, as the cuff 3.

The wipe therefore has a closed end 6, an elastic cuff 3 and an opposite end 2, two thumb ports 4, and seams at either side 7.

Advantageously a pad, formed of a different material or having a particular treatment may be adhered to the wipe. For example, if the wipe is formed of a non-woven material, a hook-type fastener may be used to adhere the pad to the wipe. Alternately, an adhesive may be used. The pad may provided various kinds of abrasives, medical treatments, surface finishes, cleansers, chemical treatments, and the like.

It should be understood that the preferred embodiments and examples described herein are for illustrative purposes only and are not to be construed as limiting the scope of the present invention, which is properly delineated only in the appended claims.

What is claimed is:

1. A wipe, comprising:

(a) a substantially rectangular hollow shell having a closed first end and an open second end, said hollow shell formed by providing a substantially rectangular microfiber sheet and folding the sheet at a mid-portion thereof to define the closed first end bridging opposite ends of the sheet together to define the open second end, the folding of the sheet forming a pair of panels, the side portions of which between the closed first end and the open second end being heat sealed to define at least one side port in said shell spaced from said first end;

(b) the second end of the shell having a constricted cuff formed by folding over a free edge of the microfiber sheet and heat sealing a portion of the sheet to itself to envelope a band having a relaxed diameter less than a relaxed diameter of the hollow shell;

(c) the side port being reinforced by providing at least two thicknesses of said microfiber material by overfolding the material at a free edge of the side port and heat sealing the thicknesses of material to each other;

(d) said hollow shell being adapted for at least one of cleaning, wiping, polishing, applying a liquid to a surface, and treating a surface, (e) said cuff being adapted to retain said hollow shell about the wrist of a human wearer, and (f) said at least one side port being adapted for insertion of a human thumb therethrough when said hollow shell is placed over a human hand.

2. The wipe according to claim 1, wherein:

said hollow shell has a length of between about 5-15 inches, and a circumference of about 5-12 inches;

said cuff having a resting circumference of about 35-80% of the circumference of the shell, and an elastic deformation limit of at least 125% of its resting circumference; and said side port is formed in a wall of said shell at a distance of about 60-200% of the circumference from said first end.

3. The wipe according to claim 1, wherein said microfiber sheet comprises a non-woven fabric.

4. The wipe according to claim 1, wherein said at least one side port has a reinforced edge comprising said at least two thicknesses of said microfiber sheet, said two thicknesses being sealed a distance away from said reinforced edge.

5. The wipe according to claim 1, wherein said band comprises an elastic ribbon.

6. The wipe according to claim 1, wherein said microfiber sheet comprises an antimicrobial agent.

7. The wipe according to claim 1, wherein said microfiber sheet is inhomogeneous.

8. The wipe according to claim 1, wherein said microfiber sheet comprises a crosslinked copolymer of at least two types of monomers each comprising a respective functional group, wherein a functional group of a first type of monomer selectively cross links with a functional group of a second type of monomer.

9. The wipe according to claim 1, wherein said microfiber sheet comprises crosslinked cellulosic fibers.

10. The wipe according to claim 1, wherein said band comprises a drawstring.

11. A method of producing a wipe, comprising:

(a) forming a substantially rectangular hollow shell having a closed first end and an open second end, by providing a substantially rectangular microfiber sheet and folding the sheet at a mid-portion thereof to define the closed first end bridging opposite ends of the sheet together to define the open second end, the folding of the sheet forming a pair of panels, the side portions of which between the closed first end and the open second end being heat sealed to define at least one side port in said shell spaced from said first end;

(b) forming a constricted cuff at the second end of the shell by folding over a free edge of the microfiber sheet and heat sealing a portion of the sheet to itself to envelope a band having a relaxed diameter less than a relaxed diameter of the hollow shell;

(c) reinforcing the side port by providing at least two thicknesses of said microfiber material by overfolding the material at a free edge of the side port and heat sealing the thicknesses of material to each other;

(d) said hollow shell being adapted for at least one of cleaning, wiping, polishing, applying a liquid to a surface, and treating a surface, (e) said cuff being adapted to retain said hollow shell about the wrist of a human wearer, and (f) said at least one side port being adapted for insertion of a human thumb therethrough when said hollow shell is placed over a human hand.

12. The method according to claim 11, wherein said hollow shell is absorbent and comprises an antimicrobial agent.

13. The method according to claim 11, wherein:

said hollow shell has a length of between about 5-15 inches, and a circumference of about 5-15 inches;

said cuff having a resting circumference of about 35-80% of the circumference of the shell, and an elastic deformation limit of at least 125% of its resting circumference; and said side port is formed in a wall of said shell at a distance of about 60-200% of the circumference from said first end.

14. The method according to claim 11, wherein said microfiber sheet comprises a non-woven fabric.

15. The method according to claim 11, wherein said at least one side port has a reinforced edge comprising said at least two thicknesses of said microfiber sheet, said two thicknesses being sealed a distance away from said reinforced edge.

16. The method according to claim 11, wherein said band comprises an elastic ribbon.

17. The method according to claim 11, wherein said microfiber sheet comprises crosslinked cellulosic fibers.

* * * * *